US007506510B2

(12) United States Patent
Thomson

(10) Patent No.: US 7,506,510 B2
(45) Date of Patent: Mar. 24, 2009

(54) SYSTEM AND METHOD FOR COOLING A STAGED AIRBLAST FUEL INJECTOR

(75) Inventor: Neal A. Thomson, Johnston, IA (US)

(73) Assignee: Delavan Inc, West Des Moines, IA (US)

( * ) Notice: Subject to any disclaimer, the term of this patent is extended or adjusted under 35 U.S.C. 154(b) by 492 days.

(21) Appl. No.: 11/333,388

(22) Filed: Jan. 17, 2006

(65) Prior Publication Data

US 2007/0163263 A1 Jul. 19, 2007

(51) Int. Cl.
*F02C 7/22* (2006.01)

(52) U.S. Cl. ..... 60/740; 60/748; 60/776

(58) Field of Classification Search ..... 60/746, 60/747, 748, 776, 804
See application file for complete search history.

(56) References Cited

U.S. PATENT DOCUMENTS

| | | | | |
|---|---|---|---|---|
| 1,875,457 | A | 9/1932 | Hemmingsen | |
| 5,570,580 | A | 11/1996 | Mains | |
| 6,523,350 | B1 | 2/2003 | Mancini et al. | |
| 6,547,163 | B1 | 4/2003 | Mansour et al. | |
| 6,672,066 | B2 | 1/2004 | Wrubel et al. | |
| 6,688,534 | B2 * | 2/2004 | Bretz | 239/8 |
| 6,718,770 | B2 | 4/2004 | Laing et al. | |
| 2003/0221429 | A1 * | 12/2003 | Laing et al. | 60/740 |
| 2004/0148937 | A1 | 8/2004 | Mancini | |
| 2004/0148938 | A1 | 8/2004 | Mancini et al. | |

FOREIGN PATENT DOCUMENTS

| | | |
|---|---|---|
| EP | 1 750 056 A8 | 2/2007 |
| GB | 2 374 406 A | 10/2002 |
| GB | 2404976 | 2/2005 |

OTHER PUBLICATIONS

UK Search report dated Apr. 14, 2008 for GB0801660.2.
UK Search Report dated May 23, 2007.

* cited by examiner

*Primary Examiner*—Michael Cuff
*Assistant Examiner*—Phutthiwat Wongwian
(74) *Attorney, Agent, or Firm*—Scott D. Wofsy; Edwards Angell Palmer & Dodge LLP

(57) ABSTRACT

A staged fuel injector is disclosed that includes a main fuel circuit for delivering fuel to a main fuel atomizer and a pilot fuel circuit for delivering fuel to a pilot fuel atomizer located radially inward of the main fuel atomizer. The pilot fuel circuit is in close proximity to the main fuel circuit enroute to the pilot fuel atomizer so that the pilot fuel flow cools stagnant fuel located within the main fuel circuit during low engine power operation to prevent coking.

19 Claims, 10 Drawing Sheets

SYSTEM AND METHOD FOR COOLING A STAGED AIRBLAST FUEL INJECTOR

BACKGROUND OF THE INVENTION

1. Field of the Invention

The subject invention is directed to fuel injection, and more particularly, to a system and method for cooling the exit slots of the main fuel circuit of a staged airblast fuel injector using the pilot fuel flow, at low engine power.

2. Background of the Related Art

Staged fuel injectors for gas turbine engines are well know in the art. They typically include a pilot fuel atomizer for use during engine ignition and low power engine operation and at least one main fuel atomizer for use during high power engine operation in concert with the pilot fuel atomizer. One difficulty associated with operating a staged fuel injector is that when the pilot fuel circuit is operating alone during low power operation, stagnant fuel located within the main fuel circuit can be susceptible to carbon formation or coking due to the temperatures associated with the operating environment. This can degrade engine performance over time.

In the past, attempts were made to passively insulate or otherwise protect the main fuel circuit of a staged fuel injector from carbon formation during low power engine operation using heat shields or vents. Efforts have also been made to actively cool a staged fuel injector using fuel flow from the pilot fuel circuit. One such effort is disclosed in U.S. Pat. No. 5,570,580 to Mains, which provides a fuel injector having two dual orifice injector tips, each with a primary and secondary pressure atomizer. There, fuel streams to the primary and secondary sprays of the pilot and main nozzle tips are arranged to transfer heat between the pilot primary fuel stream and each of the main secondary fuel stream and the pilot secondary fuel stream.

To date however, active cooling has not been used to protect against carbon formation in the main fuel circuit of a staged airblast fuel injector. Accordingly, there is a need in the art for a method of actively cooling a staged piloted air blast or dual prefilming pure airblast fuel injector to prevent carbon formation or coking in the main fuel circuit during low power engine operation and in general, to enable the pilot fuel flow to cool the main fuel circuit during high power engine operation, so as to enhance the engine performance and injector life.

SUMMARY OF THE INVENTION

The subject invention is directed to a new and useful staged fuel injector that includes a main fuel atomizer in the form of a prefilming pure air blast atomizer and a pilot fuel atomizer located radially inward of the main fuel atomizer. A main fuel circuit delivers fuel to the main fuel atomizer, and a pilot fuel circuit delivers fuel to the pilot fuel atomizer located radially inward of the main fuel atomizer.

In accordance with the subject invention, the pilot fuel circuit is in thermal contact with the main fuel circuit, enroute to the pilot fuel atomizer. In doing so, the pilot fuel flowing through the pilot fuel circuit cools or otherwise protects the main fuel circuit from carbon formation during low power operation, when the there is typically stagnant fuel located in the main fuel circuit. In addition, the close proximity of the main and pilot fuel circuits within the main fuel atomizer enables the main fuel flow to cool the pilot fuel flow when the engine is operating at high power and fuel is flowing in both circuits.

In accordance with a preferred embodiment of the subject invention, the main fuel atomizer includes, among other things, a radially outer prefilmer and a radially inner fuel swirler. The outer prefilmer and the inner fuel swirler have respective outer diametrical surfaces. Portions of the main fuel circuit are formed in the outer diametrical surface of the prefilmer and the outer diametrical surface of the fuel swirler. Radial passage means extend through the prefilmer to provide communication between the portions of the main fuel circuit formed in the outer diametrical surface of the prefilmer and the portions of the main fuel circuit formed in the outer diametrical surface of the fuel swirler.

Portions of the pilot fuel circuit are also formed in the respective outer diametrical surfaces of the prefilmer and the fuel swirler. In turn, radial passage means extend through the prefilmer to provide communication between the portions of the pilot fuel circuit formed in the outer diametrical surface of the prefilmer and the portions of the pilot fuel circuit formed in the outer diametrical surface of the fuel swirler. Also, radial passage means extend through the fuel swirler to provide communication between the pilot fuel circuit portions formed in the outer diametrical surface of the fuel swirler and the axially located pilot fuel atomizer.

The main fuel circuit includes a plurality of circumferentially spaced apart angled fuel exit slots, which are formed in the outer diametrical surface of the fuel swirler and feed into an annular main fuel spin chamber. In accordance with a preferred embodiment of the subject invention, the pilot fuel circuit is located in close proximity to the fuel exit slots of the main fuel circuit, so that the pilot fuel circuit forms a cooling channel around the main fuel circuit. Preferably, the spin chamber is configured as a self-draining spin chamber so that it is not necessary to route the pilot cooling circuit in proximity thereto.

The subject invention is further directed to a method of cooling a staged fuel injector that includes the steps of providing a main fuel circuit for delivering fuel to a main fuel atomizer, providing a pilot fuel circuit for delivering fuel to a pilot fuel atomizer located radially inward of the main fuel atomizer, and directing the pilot fuel through the pilot fuel circuit to cool stagnant fuel located within the main fuel circuit during low engine power operation to prevent coking.

These and other aspects of the subject invention will become more readily apparent to those having ordinary skill in the art from the following detailed description of the invention taken in conjunction with the drawings.

BRIEF DESCRIPTION OF THE DRAWINGS

So that those having ordinary skill in the art to which the present invention pertains will more readily understand how to employ the system and method of the present invention, embodiments thereof will be described in detail hereinbelow with reference to the drawings, wherein.

DETAILED DESCRIPTION OF THE PREFERRED EMBODIMENTS

Figure 1:
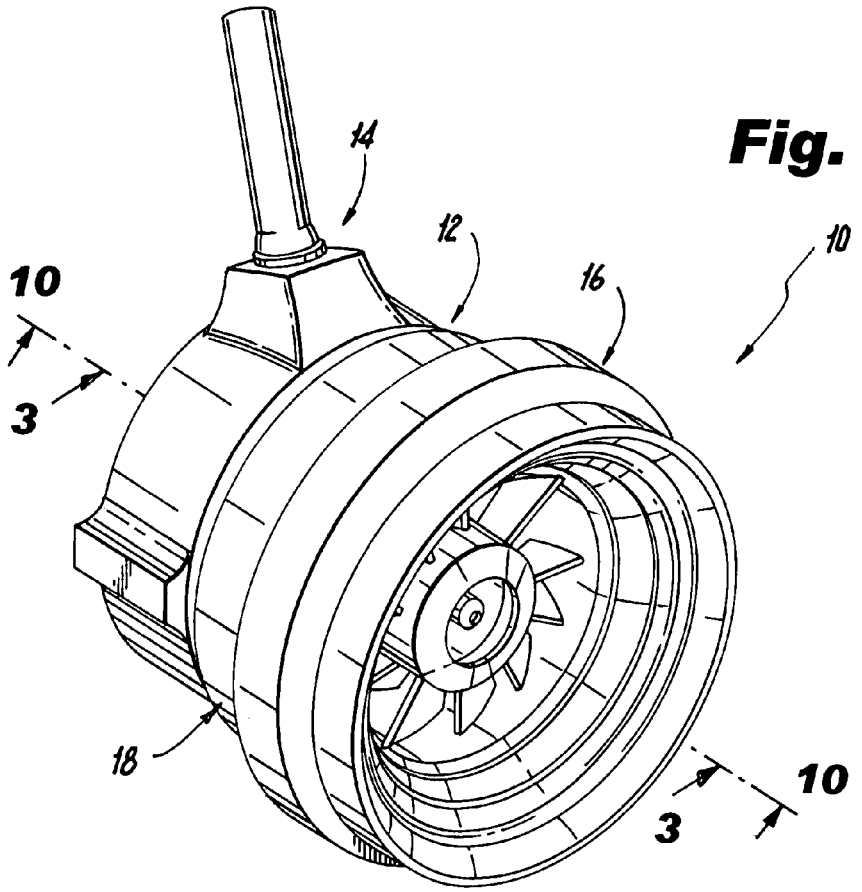
FIG. 1 is a perspective view of a staged air blast fuel injector nozzle constructed in accordance with a preferred embodiment of the subject invention, as viewed from a downstream position.

Referring now to the drawings wherein like reference numerals identify similar structural features or aspects of the subject invention, there is illustrated in FIG. 1 a fuel injector constructed in accordance with a preferred embodiment of the subject invention and designated generally by reference numeral 10. Fuel injector 10 is adapted and configured for delivering fuel to the combustion chamber of a gas turbine engine. Fuel injector 10 is generally referred to as a staged fuel injector in that it includes a pilot fuel circuit, which typically operates during engine ignition and at low engine power and a main fuel circuit, which typically operates at high engine power (e.g., at take-off and cruise) and is typically staged off at lower power operation.

Referring to FIG. 1, fuel injector 10 includes a generally cylindrical nozzle body 12, which depends from an elongated feed arm 14. In operation, main and pilot fuel is delivered into nozzle body 12 through concentric fuel feed tubes. These feed tubes include an inner/main fuel feed tube 15 and an outer/pilot fuel feed tube 17 located within the feed arm 14 (see FIGS. 3 and 6). Although not depicted herein, it is envisioned that the fuel feed tubes could be enclosed within an elongated shroud or protective strut extending from a fuel fitting to the nozzle body.

Figure 2:
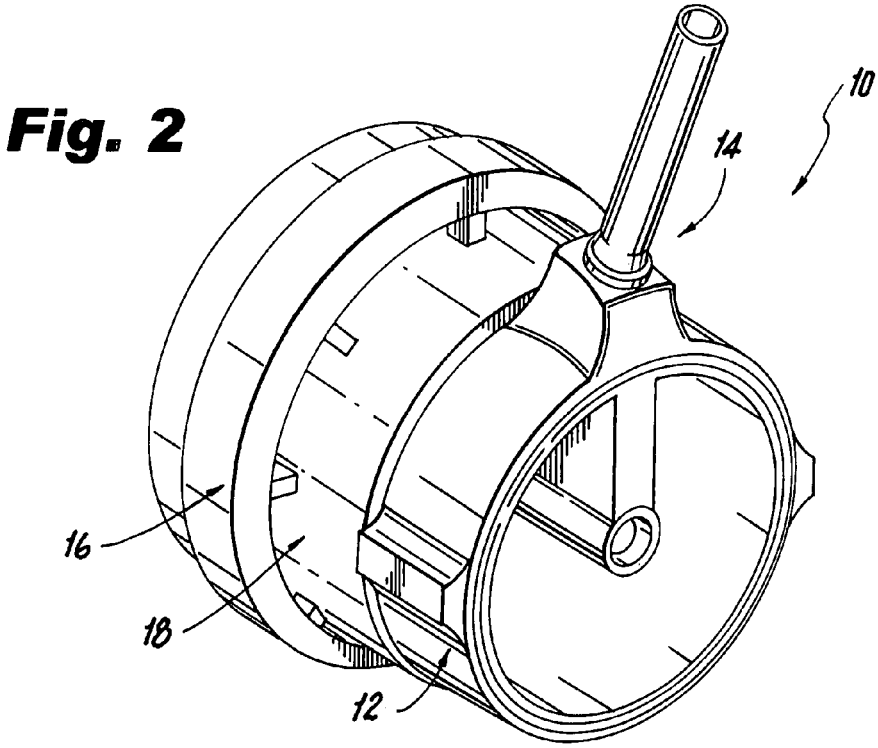
FIG. 2 is a perspective view of the staged air blast fuel injector nozzle of FIG. 1, as viewed from an upstream position.
Figure 3:
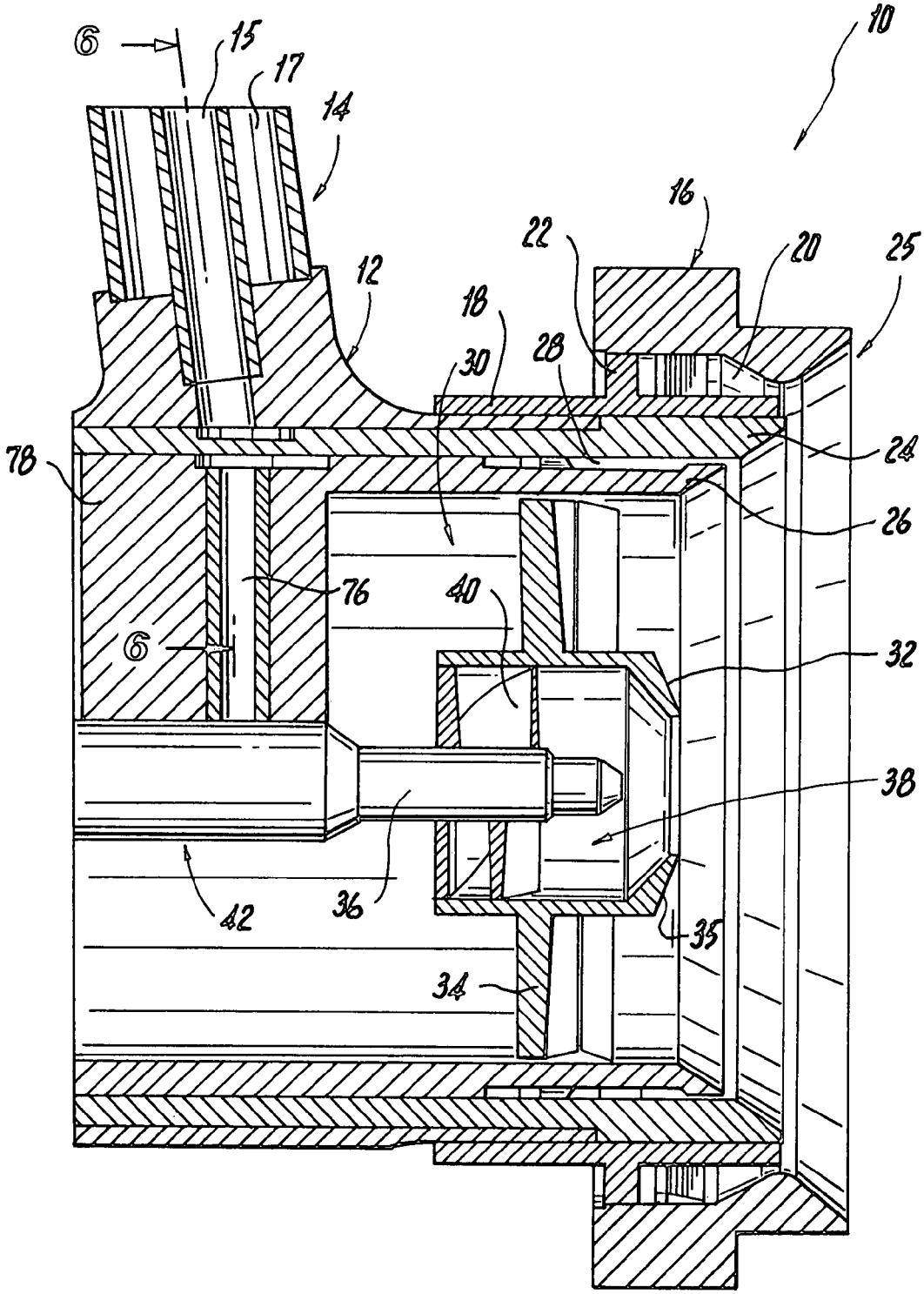
FIG. 3 is a cross-sectional view of the staged air blast fuel injector nozzle of the subject invention taken along line 3-3 of FIG. 1.
Figure 14:
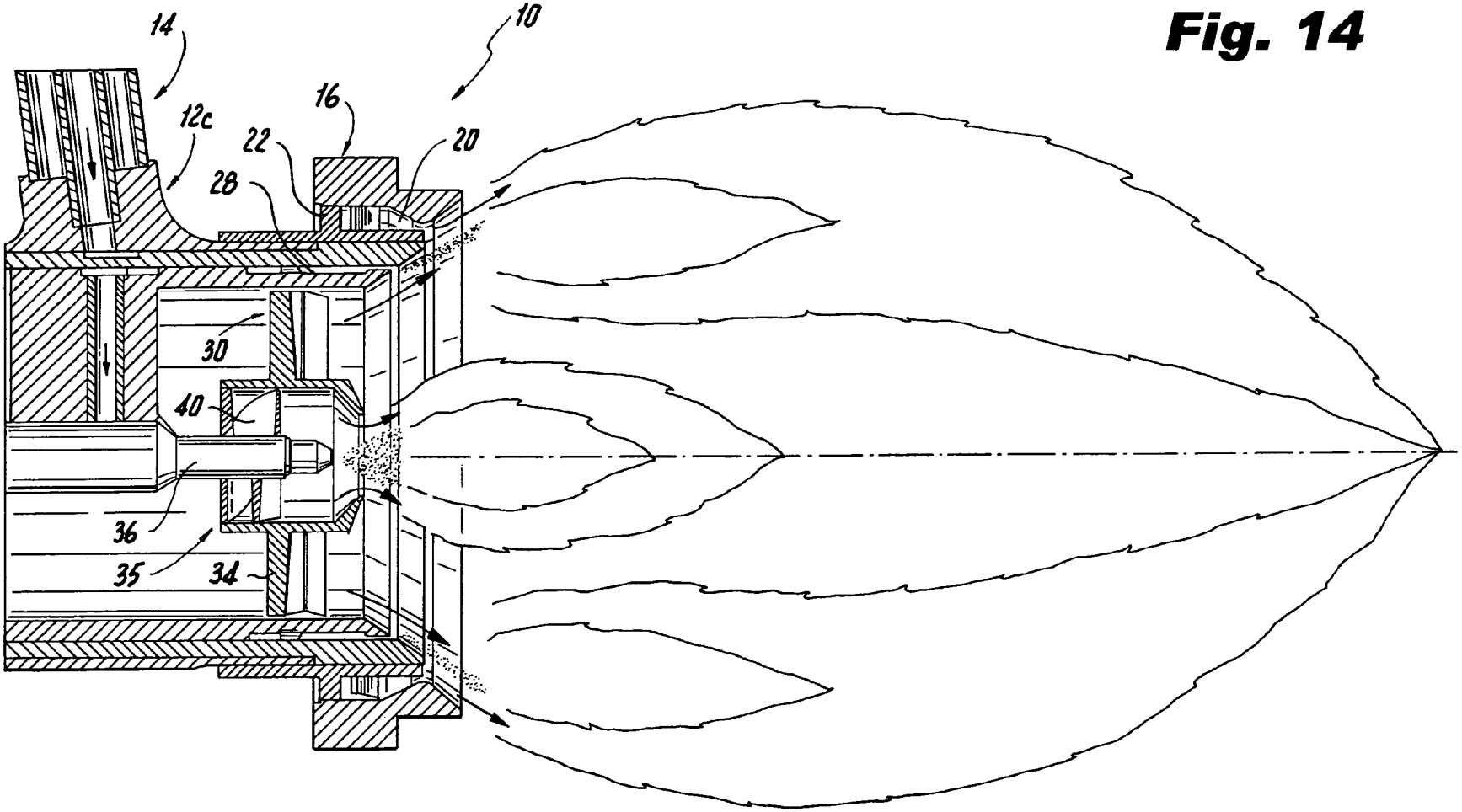
FIG. 14 is a side elevational view, in cross-section, of the staged air blast fuel injector nozzle of the subject invention during high engine power, when the pilot and main fuel circuits are operating, and wherein at such a time the main fuel circuit serves to cool the pilot fuel circuit.

At the same time fuel is delivered to nozzle body 12 through feed arm 14, pressurized combustor air is directed into the rear end of nozzle body 12 (FIG. 2) and directed through a series of main and pilot air circuits or passages, which are best seen in FIG. 3. The air flowing through the main and pilot air circuits interacts with the main and pilot fuel flows from feed arm 14. That interaction facilitates the atomization of the main and pilot fuel issued from the forward end of nozzle body 12 and into the combustion chamber of the gas turbine engine, as best seen in FIG. 14.

Referring now to FIG. 3, nozzle body 12 comprises a main fuel atomizer 25 that includes an outer air cap 16 and a main outer air swirler 18. A main outer air circuit 20 is defined between the outer air cap 16 and the outer air swirler 18. Swirl vanes 22 are provided within the main outer air circuit 20, depending from outer air swirler 18, to impart an angular component of swirl to the pressurized combustor air flowing therethrough.

An outer fuel prefilmer 24 is positioned radially inward of the outer air swirler 18 and a main fuel swirler 26 is positioned radially inward of the prefilmer 24. The prefilmer has a diverging prefilming surface at the nozzle opening. As described in more detail herein below with respect to FIG. 4, portions of the main and pilot fuel circuits are defined in the outer diametrical surfaces 24*a* and 26*a* of the prefilmer 24 and main fuel swirler 26, respectively.

The main fuel circuit receives fuel from the inner feed tube 15 and delivers that fuel into an annular spin chamber 28 located at the forward end of the main fuel atomizer. The main fuel atomizer further includes a main inner air circuit 30 defined between the main fuel swirler 26 and a converging pilot air cap 32. Swirl vanes 34 are provided within the main inner air circuit 30, depending from the pilot air cap 32, to impart an angular component of swirl to the pressurized combustor air flowing therethrough. In operation, swirling air flowing from the main outer air circuit 20 and the main inner air circuit 30 impinge upon the fuel issuing from spin chamber 28, to promote atomization of the fuel, as shown for example in FIG. 14.

With continuing reference to FIG. 3, nozzle body 12 further includes an axially located pilot fuel atomizer 35 that includes the converging pilot air cap 32 and a pilot outer air swirler 36. A pilot outer air circuit 38 is defined between the pilot air cap 32 and the pilot outer air swirler 36. Swirl vanes 40 are provided within the pilot outer air circuit 38, depending from air swirler 36, to impart an angular component of swirl to the air flowing therethrough. A pilot fuel swirler 42, shown here by way of example, as a pressure swirl atomizer, is coaxially disposed within the pilot outer air swirler 36. The pilot fuel swirler 42 receives fuel from the pilot fuel circuit by way of the inner pilot fuel bore 76 in support flange 78, described in more detail below.

Figure 4:
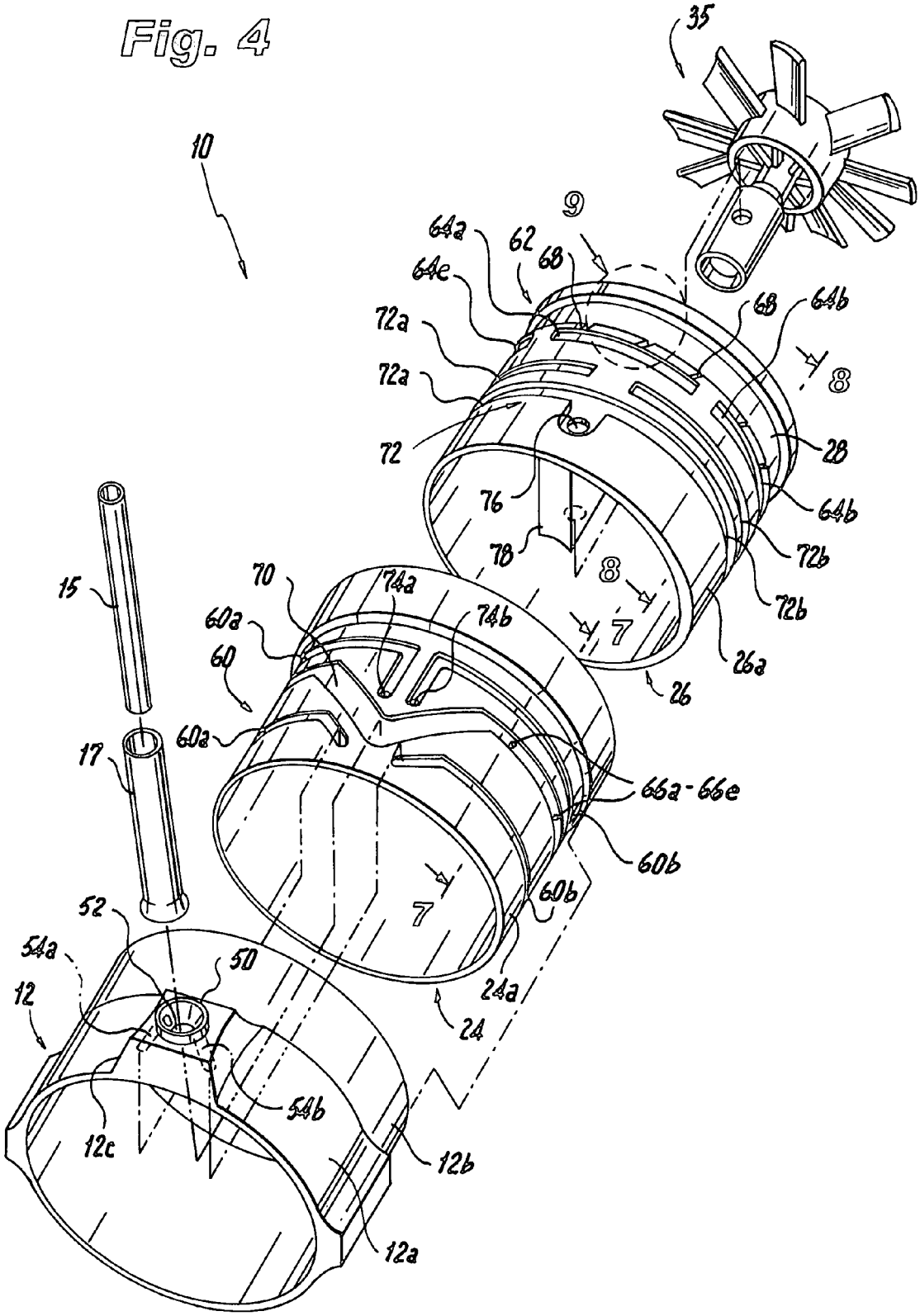
FIG. 4 is an exploded perspective view of the staged air blast fuel injector nozzle of FIG. 1, as viewed from above.
Figure 6:
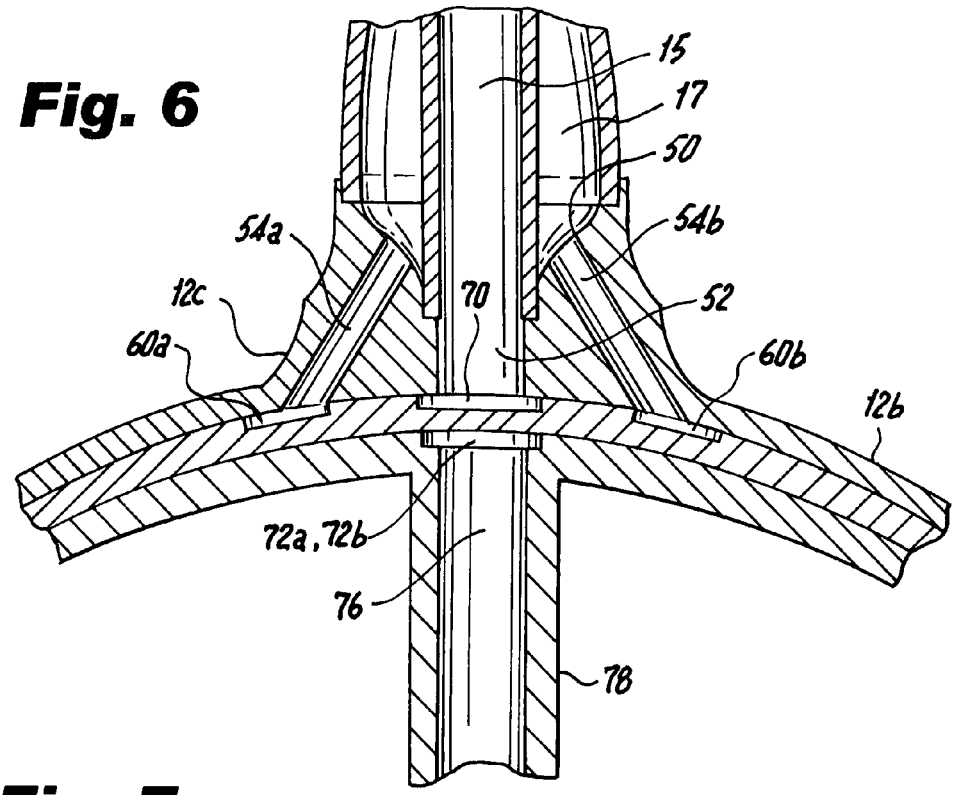
FIG. 6 is a cross-sectional view taken along line 6-6 of FIG. 3, illustrating the main and pilot fuel inlet passages of the staged air blast fuel injector nozzle of FIG. 1.

Referring now to FIG. 4 in conjunction with FIGS. 3 and 6, nozzle body 12 includes a rearward tube mounting section 12*a* and a forward atomizer mounting section 12*b* of reduced outer diameter. Tube mounting section 12*a* includes radially projecting mounting appendage 12*c* that defines a primary fuel bowl 50 for receiving concentric fuel tube 15 and 17 of feed arm 14 (see FIG. 6). A central pilot fuel bore 52 extends from fuel bowl 50 for communicating with inner/main fuel tube 15 to deliver fuel to the main fuel circuit defined in the outer diametrical surfaces of the prefilmer 24 and fuel swirler 26. Dual pilot fuel bores 54*a*, 54*b* communicate with and extend from fuel bowl 50 for delivering pilot/cooling fuel from outer/pilot fuel tube 15 to the pilot fuel circuit defined in the outer diametrical surfaces of the prefilmer 24 and fuel swirler 26.

Figure 5:
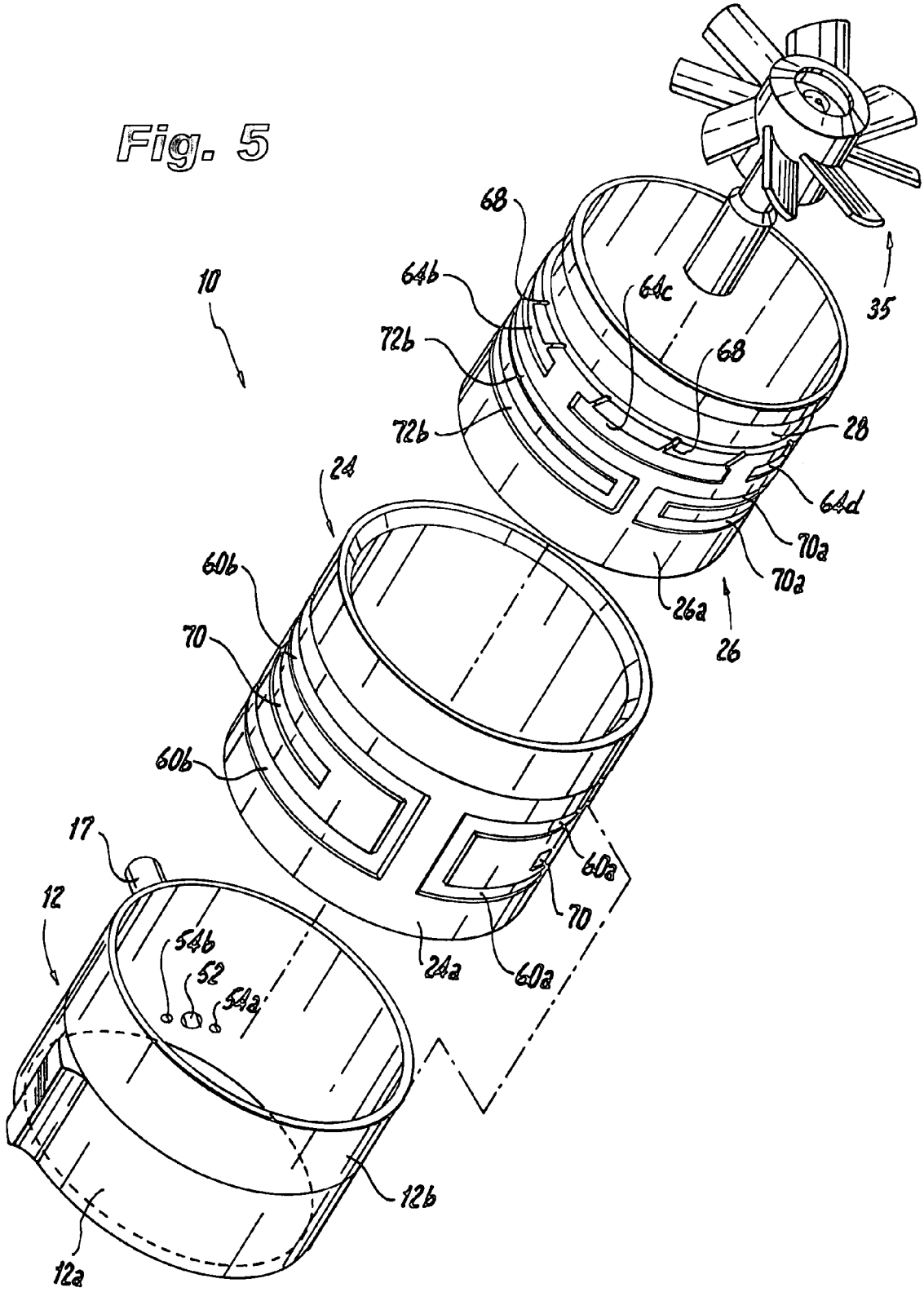
FIG. 5 is an exploded perspective view of the staged air blast fuel injector nozzle of FIG. 1, as viewed from below.
Figure 7:
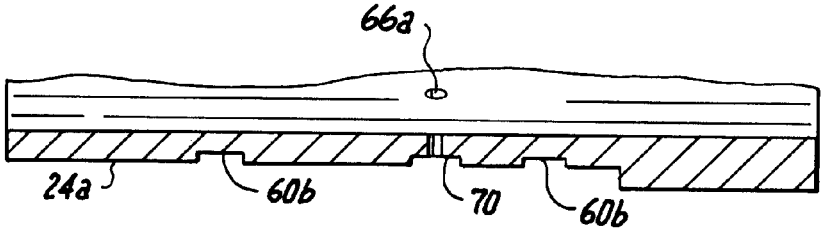
FIG. 7 is a cross-sectional view taken along line 7-7 of FIG. 4, illustrating portions of the main and pilot fuel circuits formed in the prefilmer of the main fuel atomizer of the staged air blast fuel injector nozzle shown in FIG. 1.

Referring to FIGS. 4 and 5, the outer diametrical surface 24*a* of outer prefilmer 24 and the outer diametrical surface 26*a* of main fuel swirler 26 include machined channels or grooves that form portions of the main and pilot fuel circuits or pathways. The main and pilot fuel circuits are separated from one another by braze seals or other known joining or sealing techniques. More particularly, an outer pilot fuel circuit 60 consisting of two generally U-shaped fuel circuit half-sections 60*a* and 60*b*, and a main fuel circuit 70 are formed in the outer diametrical surface 24*a* of the outer prefilmer 24 (see FIG. 7). Outer main fuel circuit 70 is located between the legs of the two pilot fuel circuit half-sections 60*a* and 60*b*. By way of pilot fuel tube 17, the outer pilot fuel circuit half-section 60*a* receives fuel from pilot fuel bore 54*a*, and outer pilot fuel circuit half-section 60*b* receives fuel from pilot fuel bore 54*b* (see FIG. 12). The outer main fuel circuit 70 receives fuel from central fuel bore 52, by way of inner fuel tube 15.

Figure 8:
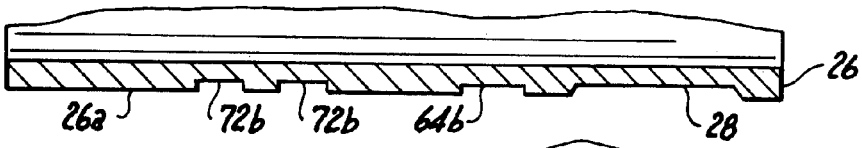
FIG. 8 is a cross-sectional view taken along line 8-8 of FIG. 4, illustrating portions of the main and pilot fuel circuits formed in the fuel swirler of the main fuel atomizer of the staged air blast fuel injector nozzle shown in FIG. 1.
Figure 9:
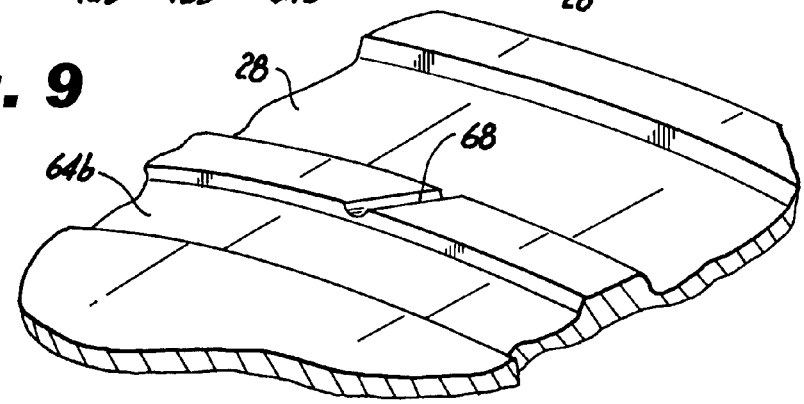
FIG. 9 is a localized perspective view of the outer diametrical surface of the fuel swirler shown in FIG. 4, illustrating an angled exit slot of the main fuel circuit, which feeds the swirl chamber of the fuel swirler.

With continuing reference to FIGS. 4 and 5, the inner main fuel circuit 62 of main fuel atomizer 25 is formed in the outer diametrical surface 26*a* of main fuel swirler 26. The inner main fuel circuit 62 includes circumferentially disposed fuel distribution troughs 64*a*-64*e*. Each fuel distribution trough 64*a*-64*e* receives fuel from a respective radial fuel transfer port 66*a*-66*e* associated with the main outer fuel circuit 70 in prefilmer 24 and extending radially through the prefilmer 24 (see FIGS. 8 and 13). Each fuel distribution trough 64*a*-64*e* includes a plurality of angled exit slots 68 that deliver fuel to the annular spin chamber 28 defined in the outer diametrical surface 26*a* of fuel swirler 26 (see FIGS. 9 and 13).

The inner pilot fuel circuit 72 of pilot fuel atomizer 35 is also formed in the outer diametrical surface 26*a* of fuel swirler 26. The inner pilot fuel circuit 72 includes independently initiating but commonly terminating U-shaped circuit half-sections 72*a* and 72*b*. The pilot circuit half-sections 72*a* and 72*b* are fed fuel from respective radial transfer ports 74*a* and 74*b* associated with outer pilot fuel circuit half-sections 60*a* and 60*b*, respectively and extending radially through the prefilmer 24 (see FIG. 4). Fuel from the pilot circuit half-sections 72*a* and 72*b* is directed to the pilot fuel swirler 42 through an inner pilot fuel bore 76 formed in pilot atomizer support flange 78, which depends from the interior surface of fuel swirler 26 (see FIGS. 3 and 6).

Figure 12:
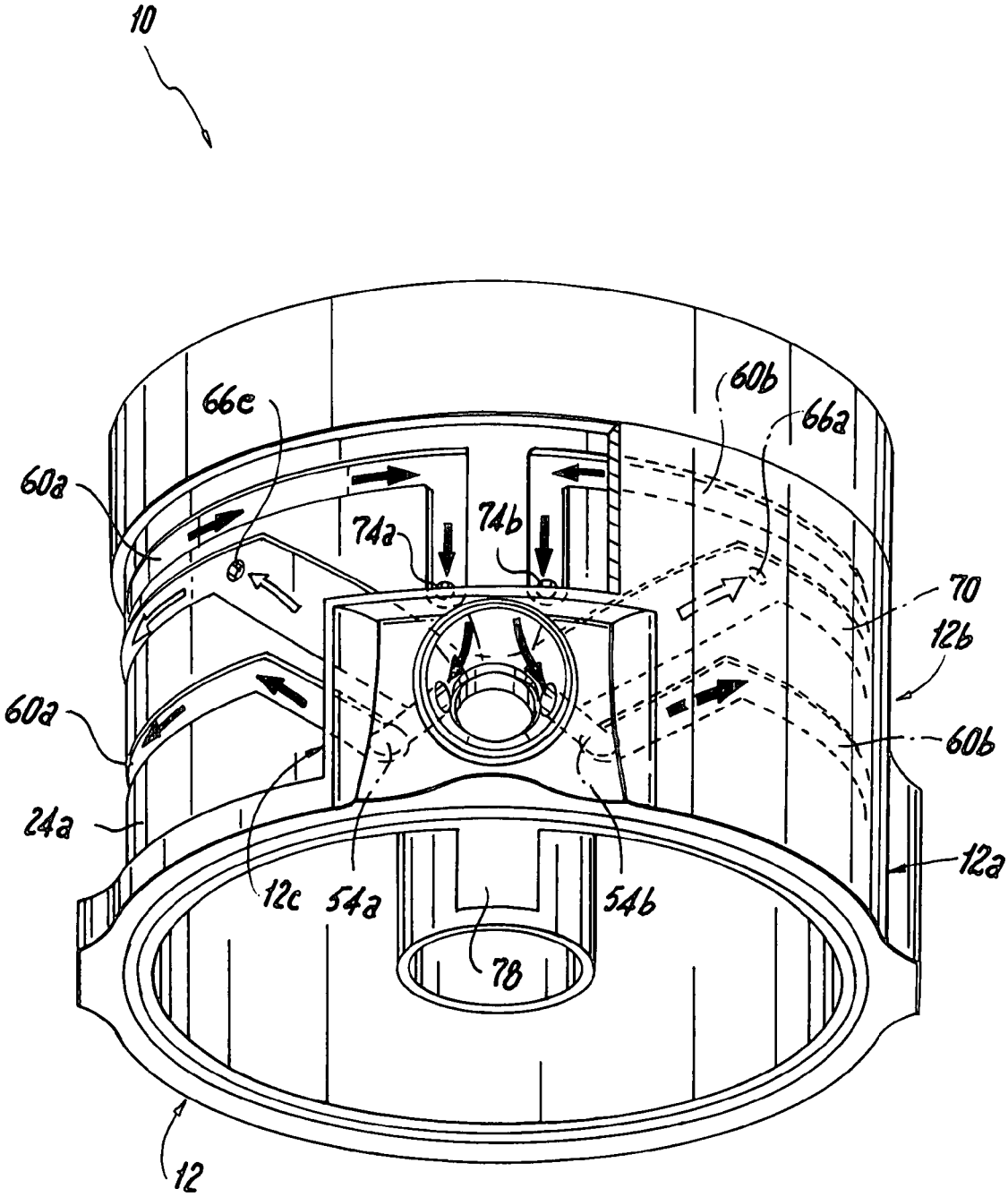
FIG. 12 is a perspective view as in FIG. 11, with an arcuate section of the nozzle body removed to illustrate the main and pilot fuel flow pattern in the outer diametrical surface of the prefilmer, wherein the pilot fuel flow pattern is identified by solid indicator arrows and the main fuel flow pattern is identified by hollow indicator arrows.
Figure 13:
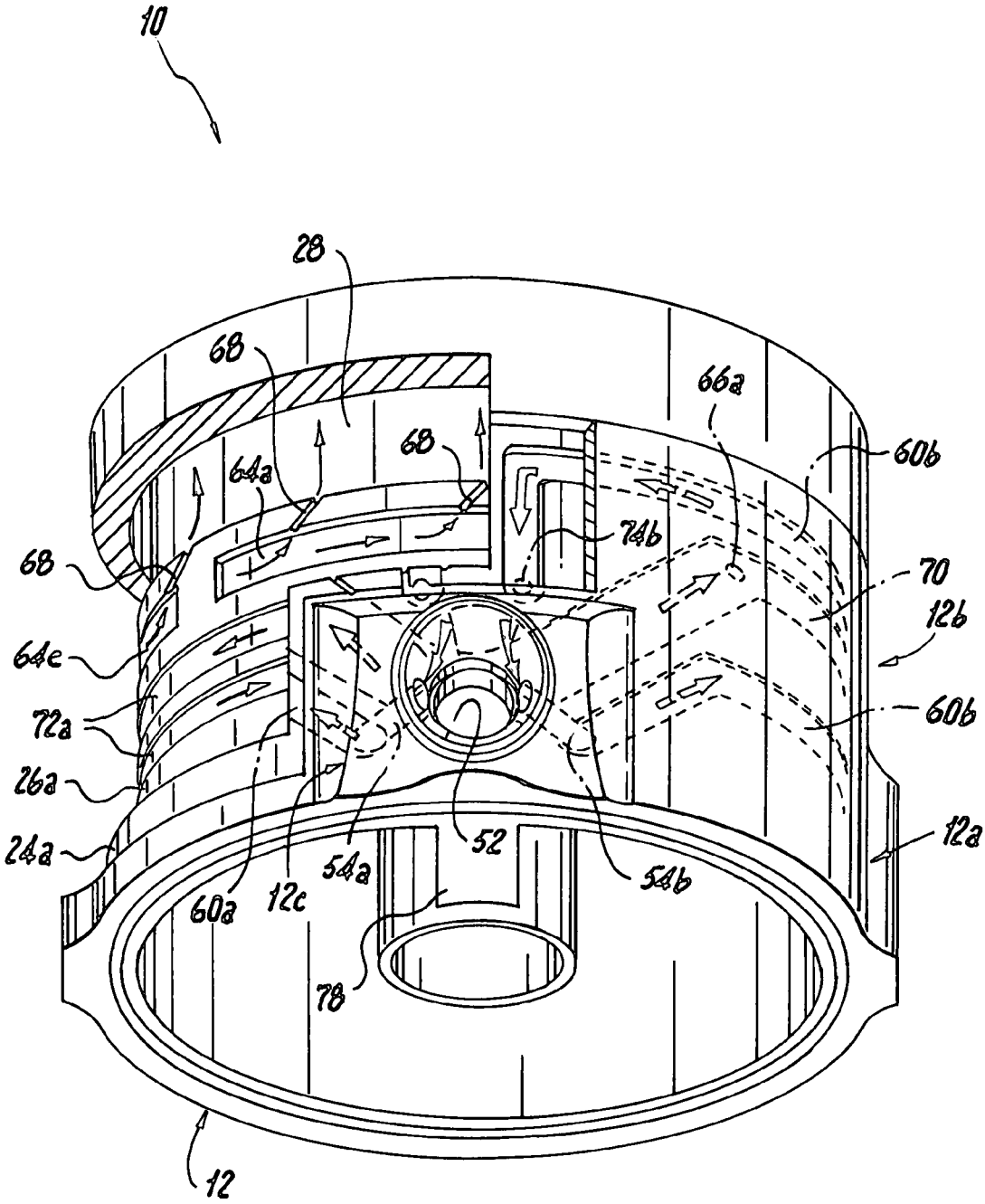
FIG. 13 is a perspective view as in FIG. 11, with arcuate sections of the nozzle body and prefilmer removed to illustrate the main and pilot fuel flow patterns in the outer diametrical surface of the fuel swirler.

In accordance with the subject invention, fuel traveling through the outer and inner pilot fuel circuits 70, 72 is directed into thermal contact with the outer and inner main fuel circuits 60, 62, enroute to the pilot fuel atomizer 35 located along the axis of nozzle body 12, as illustrated in FIGS. 12 and 13. More particularly, as best seen in FIGS. 4 and 5, the outer pilot circuit half-sections 60*a* and 60*b* substantially surround the outer main fuel circuit 70. In addition, the outer pilot half section 60*a* and 60*b* are located above the inner main fuel circuit 72, to provide further thermal protection. In doing so, the pilot fuel flowing through the pilot outer and inner fuel circuit 60 and 62, protects the main inner fuel circuit 62 and in particular, the main exit slots 68 that feed spin chamber 28 from carbon formation during low power operation, when there is typically stagnant fuel located in the main inner fuel circuit 62.

Figure 10:
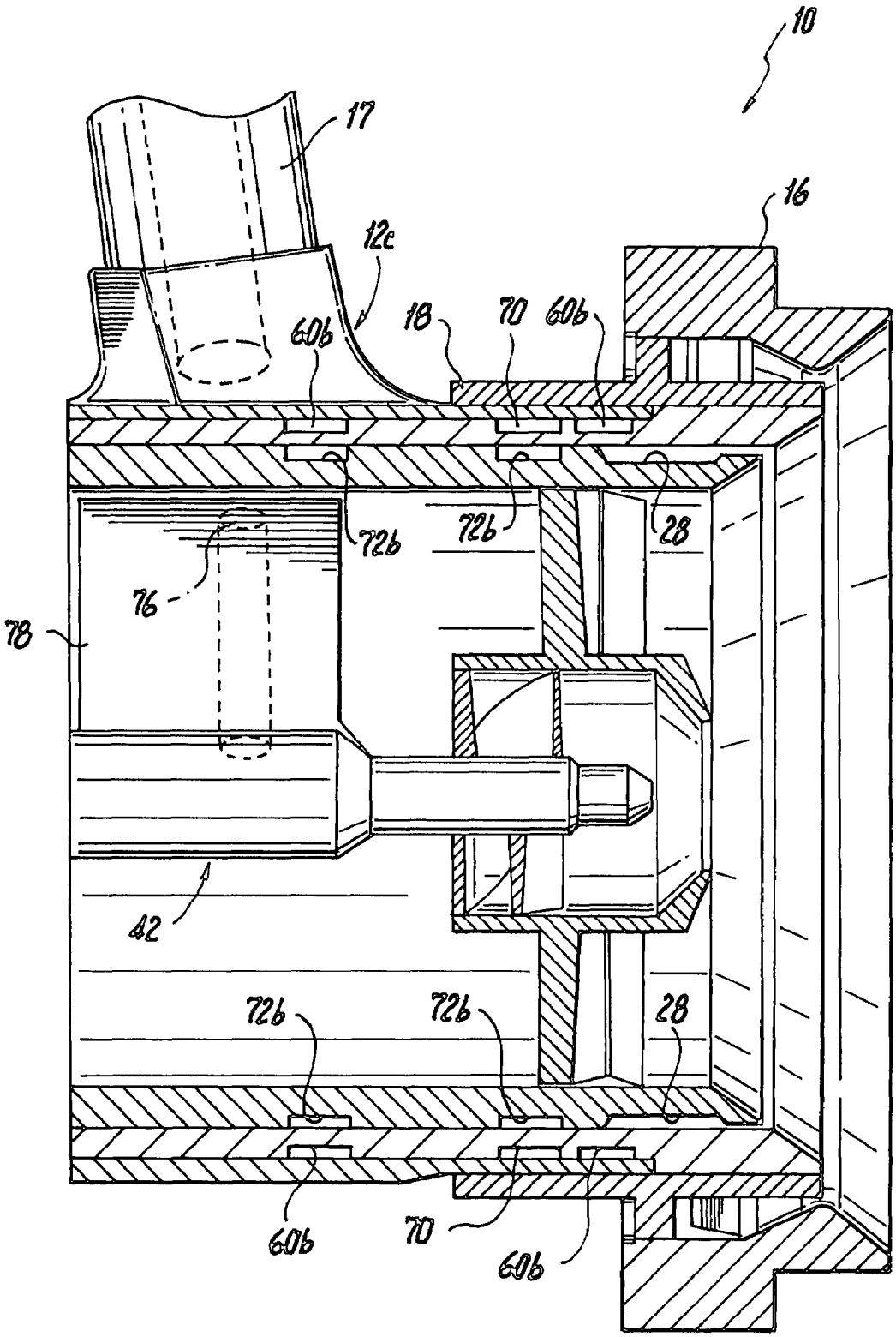
FIG. 10 is a cross-sectional view of the staged air blast fuel injector nozzle of the subject invention taken along line 10-10 of FIG. 1, rotated about the axial centerline of the nozzle relative to FIG. 3, so as to illustrated the main and pilot fuel circuits of the main fuel atomizer.
Figure 11:
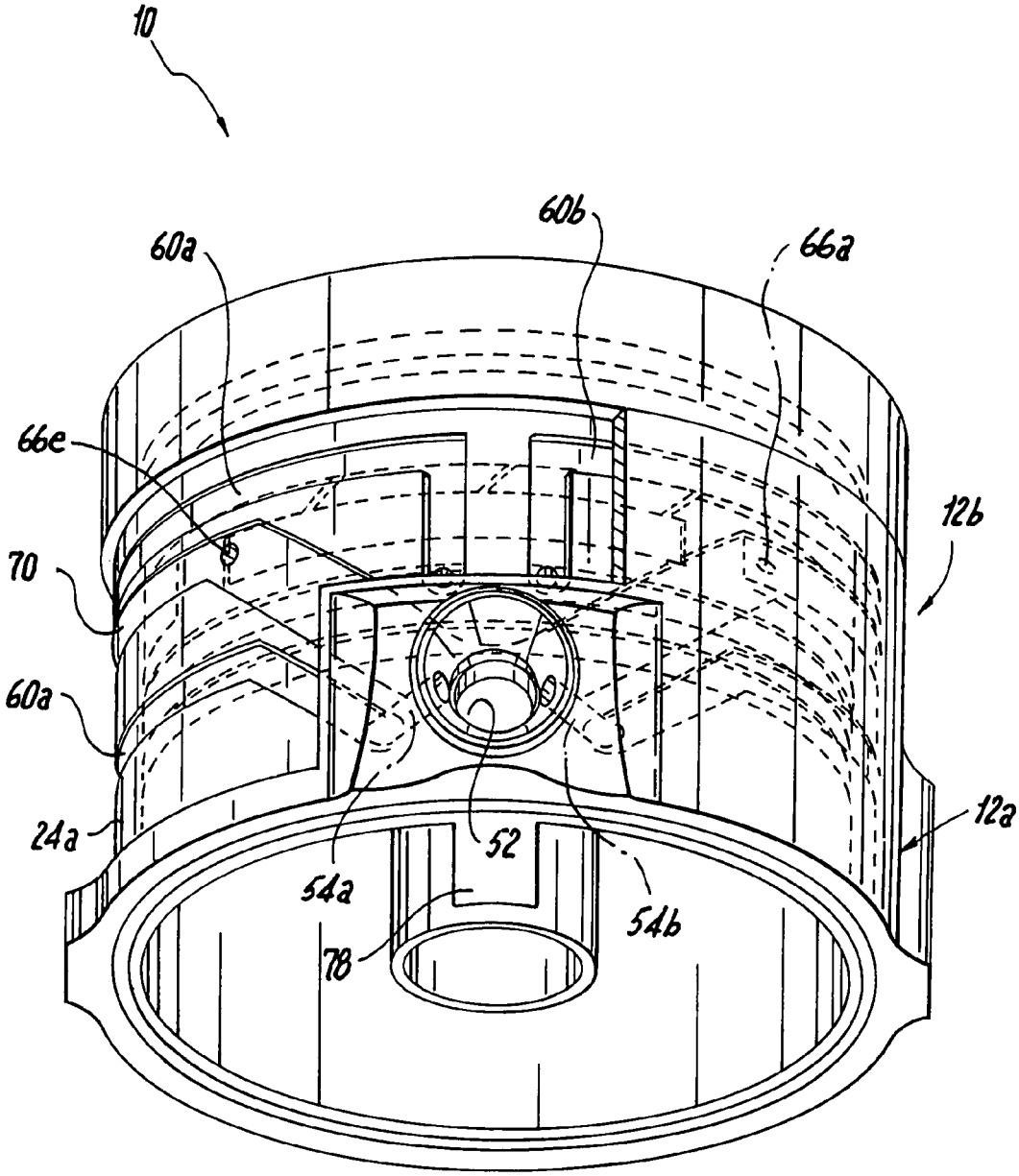
FIG. 11 is a perspective view of the fuel injector of FIG. 1, with the main and pilot fuel supply tubes removed for ease of illustration, and wherein hidden lines illustrate the main and pilot fuel circuits formed in respective outer diametrical surfaces of the prefilmer and swirler.

As best seen in FIG. 10, the close proximity of the main outer and inner fuel circuits 60, 62 and pilot inner and outer fuel circuits 70, 72 enables the main fuel flow to cool the pilot fuel flow when the engine is operating at high power and fuel is flowing within both the main and pilot fuel circuits. In essence, the pilot cooling channels act as a multi-pass (or counter-flow) heat exchanger to improve pilot cooling effectiveness.

Furthermore, pilot fuel enroute to cool the main exits slots 68 of the main inner fuel circuit 62 is in close proximity to pilot fuel flow returning from cooling the main exit slots 68. Since the heat gain per unit length of travel by the pilot fuel flow is minimal, this pilot fuel flow pattern effectively doubles the cooling capacity of the pilot fuel in a given area.

It should be recognized by those skilled in the art that the full extent of the main fuel atomizer of injector 10 is not cooled by the pilot fuel flow traveling through the inner and outer portions of the pilot fuel circuit 70, 72. Specifically, the external filming surfaces of prefilmer 24 and the spin chamber 28 in fuel swirler 26 downstream from the main exit slots 68 are not cooled through thermal interaction with the pilot fuel channels. Moreover, the pilot fuel does not have the cooling capacity to keep the temperature of these exposed surfaces below a point where carbon would form when the main atomizer is staged off.

Instead, in accordance with an aspect of the subject invention, when the main atomizer is staged off, fuel remaining within the spin chamber 28 is removed therefrom, so there is no need to control the temperature in this area. To accomplish this, the prefilmer 24 incorporates a self-draining spin chamber 28. Accordingly, the force of gravity pulls the remaining fuel to the bottom of the spin chamber 28 and from there, down the diverging conical surface of the prefilmer 24. The fuel is then drawn off the filming surface of prefilmer 24 by high-speed airflow passing across the main atomizer by way of main inner air circuit 30.

Although the subject invention has been described with respect to preferred embodiments, those skilled in the art will readily appreciate that changes and modifications may be made thereto without departing from the spirit and scope of the subject invention as defined by the appended claims.

What is claimed is:

1. A staged fuel injector comprising:

a) a main fuel circuit for delivering fuel to a main fuel atomizer, the main fuel atomizer including a radially outer prefilmer having an outer diametrical surface, wherein portions of the main fuel circuit are formed in the outer diametrical surface of the prefilmer; and b) a pilot fuel circuit for delivering fuel to a pilot fuel atomizer located radially inward of the main fuel atomizer, wherein portions of the pilot fuel circuit are formed in the outer diametrical surface of the prefilmer, and wherein the pilot fuel circuit is in thermal contact with the main fuel circuit enroute to the pilot fuel atomizer.

2. A staged fuel injector as recited in claim 1, wherein the main fuel atomizer further includes a radially inner fuel swirler having an outer diametrical surface, and wherein portions of the main fuel circuit are formed in the outer diametrical surface of the fuel swirler.

3. A staged fuel injector as recited in claim 2, wherein radial passage means extend through the prefilmer to provide communication between the portions of the main fuel circuit formed in the outer diametrical surface of the prefilmer and the portions of the main fuel circuit formed in the outer diametrical surface of the fuel swirler.

4. A staged fuel injector as recited in claim 2, wherein portions of the pilot fuel circuit are formed in the outer diametrical surface of the fuel swirler.

5. A staged fuel injector as recited in claim 4, wherein radial passage means extend through the prefilmer to provide communication between the portions of the pilot fuel circuit formed in the outer diametrical surface of the prefilmer and the portions of the pilot fuel circuit formed in the outer diametrical surface of the fuel swirler.

6. A staged fuel injector as recited in claim 5, wherein a radial passage extends through the fuel swirler to provide communication between the pilot fuel circuit and the pilot atomizer.

7. A staged fuel injector as recited in claim 1, wherein the main fuel atomizer includes a fuel swirler radially inward of the prefilmer, wherein the main fuel circuit includes a plurality of fuel exit slots formed in the fuel swirler, and wherein the pilot fuel circuit is located in close proximity to the fuel exit slots of the main fuel circuit.

8. A staged fuel injector as recited in claim 7, wherein the fuel exit slots communicate with a spin chamber formed in the fuel swirler.

9. A staged fuel injector as recited in claim 8, wherein the spin chamber is configured as a self-draining spin chamber.

10. A staged fuel injector comprising:

a) a main fuel atomizer including a radially outer prefilmer having an outer diametrical surface and a radially inner fuel swirler having an outer diametrical surface;

b) a main fuel circuit formed in the main fuel atomizer and including an outer main fuel circuit portion formed in the outer diametrical surface of the prefilmer and an inner main fuel circuit portion formed in the outer diametrical surface of the inner fuel swirler;

c) a pilot fuel circuit formed in the main fuel atomizer and including an outer pilot fuel circuit portion formed in the outer diametrical surface of the prefilmer and an inner pilot fuel circuit portion formed in the outer diametrical surface of the inner fuel swirler; and d) a pilot fuel atomizer axially located within the main fuel atomizer, and communicating with the pilot fuel circuit.

11. A staged fuel injector as recited in claim 10, wherein the pilot fuel circuit is in close proximity to the main fuel circuit such that pilot fuel flow serves to cool stagnant fuel located within the main fuel circuit during low engine power operation, and thereby prevent coking in the main fuel circuit.

12. A staged fuel injector as recited in claim 10, wherein radial passage means extend through the prefilmer to provide communication between the outer main fuel circuit portion formed in the outer diametrical surface of the prefilmer and the inner main fuel circuit portion formed in the outer diametrical surface of the inner fuel swirler.

13. A staged fuel injector as recited in claim 10, wherein radial passage means extend through the prefilmer to provide communication between the outer pilot fuel circuit portions formed in the outer diametrical surface of the prefilmer and the inner pilot fuel circuit portions formed in the outer diametrical surface of the inner fuel swirler.

14. A staged fuel injector as recited in claim 10, wherein radial passage means extend through the inner fuel swirler to provide communication between the inner pilot fuel circuit portions formed in the outer diametrical surface of the inner fuel swirler and the pilot fuel atomizer.

15. A staged fuel injector as recited in claim 10, wherein the main fuel circuit includes a plurality of fuel exit slots formed in the inner fuel swirler, and wherein the pilot fuel circuit is located in close proximity to the fuel exit slots of the main fuel circuit.

16. A staged fuel injector as recited in claim 15, wherein the fuel exit slots communicate with a spin chamber formed in the inner fuel swirler.

17. A staged fuel injector as recited in claim 16, wherein the spin chamber is configured as a self-draining spin chamber.

18. A method of cooling a staged fuel injector comprising:

a) providing a main fuel circuit for delivering fuel to a main fuel atomizer, the main fuel atomizer including a radially outer prefilmer having an outer diametrical surface, wherein portions of the main find circuit are formed in the outer diametrical surface of the prefilmer;

b) providing a pilot fuel circuit for delivering fuel to a pilot fuel atomizer located radially inward of the main fuel atomizer, wherein portions of the pilot fuel circuit are formed in the outer diametrical surface of the prefilmer; and c) directing fuel through the pilot fuel circuit to cool stagnant fuel located within the main fuel circuit during low engine power operation to prevent coking.

19. A method according to claim 18, further comprising the step of cooling the fuel flowing through the pilot fuel circuit with fuel flowing through the main fuel circuit during high engine power operation.

* * * * *